United States Patent [19]

Luz

[11] 4,432,194

[45] Feb. 21, 1984

[54] METHOD AND APPARATUS FOR SPLICING THREAD ENDS

[75] Inventor: Rudolf Luz, Horgen, Switzerland

[73] Assignee: Maschinenfabrik Schweiter AG, Switzerland

[21] Appl. No.: 329,331

[22] Filed: Dec. 10, 1981

[30] Foreign Application Priority Data

Jan. 16, 1981 [CH] Switzerland ..... 300/81

[51] Int. Cl.[3] ..... D01H 15/00

[52] U.S. Cl. ..... 57/22

[58] Field of Search ..... 57/22, 23, 261, 350, 57/351, 908

[56] References Cited

U.S. PATENT DOCUMENTS 3,339,362 9/1967 Dodson et al. ..... 57/22 X
3,487,618 1/1970 Arguelles ..... 57/22
3,581,486 6/1971 Dibble ..... 57/22
3,867,810 2/1975 Meerters et al. ..... 57/22 X
4,096,687 6/1978 McDonald ..... 57/350 X

*Primary Examiner*—Donald Watkins
*Attorney, Agent, or Firm*—Roylance, Abrams, Berdo & Goodman

[57] ABSTRACT

A splicing head has a turbulence chamber which is circular in cross section. The turbulence chamber is cylindrical or has a cylindrical center portion and conical outwardly enlarging end portion, and an insertion slot. Air inlet passages open into the cylindrical portion along tangents and in opposite directions so that air under pressure through the passages creates circumferential flow in opposite directions. Air is supplied alternately to the two passages, creating oppositely alternating air currents in the chamber, thereby twisting and joining thread ends inserted through the slot into the chamber without having overtwisted or untwisted portions.

10 Claims, 6 Drawing Figures

METHOD AND APPARATUS FOR SPLICING THREAD ENDS

This invention relates to a method for twisting and splicing thread ends to join them together, and to a splicing head apparatus for performing the method.

BACKGROUND OF THE INVENTION

In known splicing devices for joining together two thread ends, a turbulence chamber is provided, the chamber normally being constructed as a cylindrical channel. The two oppositely directed thread ends to be joined together are inserted in the channel. In the axial center of the turbulence chamber is placed a compressed air passage having an opening which is tangential to the peripheral wall of the turbulence chamber and through which compressed air is blown into the chamber so that the two thread ends are jointly subjected to turbulence and are joined. In the known devices, a disadvantage exists that, although the tangentially entering air leads to good turbulence effect on the fibers of the thread ends, an angular momentum is produced, increasing the twist of the thread ends at one side of the turbulence chamber and decreasing or even eliminating the twist on the other side thereof. Overtwisting the thread end at one side can damage individual fibers, whereas on the other side a weak point with reduced tensile strength is formed due to the lack of a reciprocal hold in the region of reduced or non-existant twist. An example of this is shown in German Offenlegungsschrift No. 28 56 514.

This method has the further disadvantage that, on one side of the splicing point, the twisting direction of the spliced joint coincides with the prior twist of the thread, whereas on the other side of the splicing point the twisting direction is opposite to that of the twisting direction of the thread. Therefore, different turbulence chambers are required for S- and Z-yarns in order to be sure that, during further processing, the end with the coinciding twisting direction of the splicing joint always passes through before the other end with the non-coinciding twisting direction. In addition, any remanent bobbins must be re-wound twice to fulfill the aforementioned condition. However, this involves additional stressing and higher processing costs in connection with the thread.

In another known splicing apparatus, shown in German Offenlegungsschrift No. 28 15 999, the turbulence chamber has a trapezoidal cross-section in which the larger trapezoidal side is formed by a cover which can be pivoted for opening and closing the turbulence chamber. As in other known turbulence chambers, the compressed air is injected into the center of the chamber through openings located on the smaller trapezoidal side of the chamber cross-section facing the cover. This arrangement produces air eddy currents in the turbulence chamber which are undefined to a greater or lesser extent, so that there is also undefined mixing of the fibers.

BRIEF SUMMARY OF THE INVENTION

Accordingly, an object of the invention is to provide a method for splicing two thread ends such that a uniform, clean connection of the thread ends is achieved without overtwisting or weak points, and is produced independently of the previously existing twisting direction of the thread ends to be joined.

As will be recognized, the term "thread" is used herein to indicate a thread or yarn which includes S- or Z-twisted fibers.

Briefly described, the invention includes a method for splicing two thread ends comprising the steps of providing a splicing head having a turbulence chamber with a generally circular cross-section for receiving the thread ends to be spliced, inserting the thread ends into the chamber, tangentially injecting a fluid medium under pressure into the turbulence chamber through at least one first inlet opening to cause generally circular fluid flow in the chamber in one circumferential direction, terminating flow through the first inlet opening, tangentially injecting a fluid medium under pressure into the turbulence chamber through at least one second inlet opening to cause generally circular fluid flow in the chamber in the opposite circumferential direction, terminating flow through the second inlet opening, and repeating the steps of tangentially injecting and terminating flow alternately through the first and second openings.

In another aspect, the invention includes a splicing head for joining two thread ends together comprising a body having therein means defining a turbulence chamber with a generally circular cross-section, means defining an insertion slot extending inwardly from an outer surface of said body to said chamber for permitting insertion into said chamber of the thread ends to be joined, means defining at least one first fluid flow passage tangentially intersecting said chamber in a direction to cause circumferential flow in a clockwise direction within said chamber when supplied with fluid under pressure, and means defining at least one second fluid flow passage tangentially intersecting said chamber in a direction to cause circumferential flow in a counterclockwise direction when supplied with fluid under pressure, and means for alternately supplying fluid under pressure to said first and second passages.

In accordance with the method of the invention there is provided a splicing head which has a turbulence chamber with an insertion slot for inserting the thread ends into the chamber, and in the chamber there is at least one clockwise-directed pressure medium channel and at least one counter clockwise-directed pressure medium channel, alternately subjected to the action of the pressure medium, and whose openings pass tangentially into the peripheral wall of the chamber.

BRIEF DESCRIPTION OF THE DRAWINGS

In order that the manner in which the foregoing and other objects are attained in accordance with the invention can be understood in detail, particularly advantageous embodiments thereof will be described with reference to the accompanying drawings, which form a part of this specification, and wherein.

Figure 1:
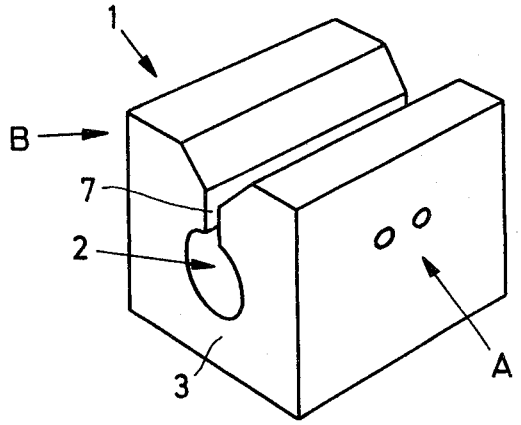
FIG. 1 is a perspective view of a splicing head in accordance with the invention showing multiple pressure medium passages on either side of the turbulence chamber formed therein.
Figure 2:
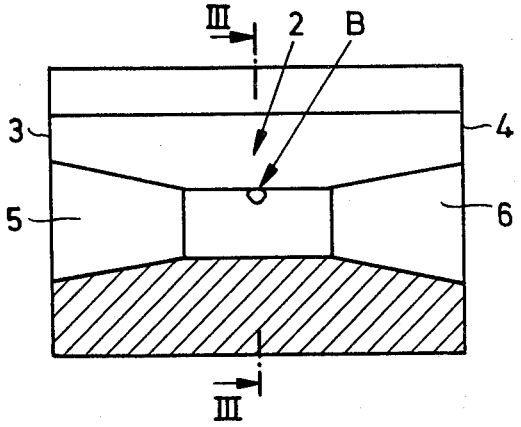
FIG. 2 is a longitudinal section through a splicing head in accordance with the invention having single pressure medium inlet passages.

Turning now to the drawings in detail, it will be seen that FIG. 1 shows a splicing head comprising a generally rectangular body indicated generally at 1 having a turbulence chamber 2 of circular cross section extending axially therethrough. The turbulence chamber 2 can be generally cylindrical, but is preferably formed as illustrated in FIG. 2 so that it has a central generally cylindrical portion and frustoconical end portions 5 and 6 which enlarge outwardly toward end faces 3 and 4 of the body 1. In either embodiment, the splicing head is provided with pressure medium passages indicated generally at A and B which are arranged to inject fluid under pressure, such as air, into the central portion of the turbulence chamber. As will be seen in FIG. 3, the pressure medium passages A, B are conveniently positioned on opposite sides of turbulence chamber 2. In the embodiment of FIG. 1, there are two each of passages A and B, whereas in the embodiment of FIGS. 2 and 3 there is in each case only one each of passages A and B. The number of passages is particularly dependent upon the nature of the thread material to be spliced.

Figure 3:
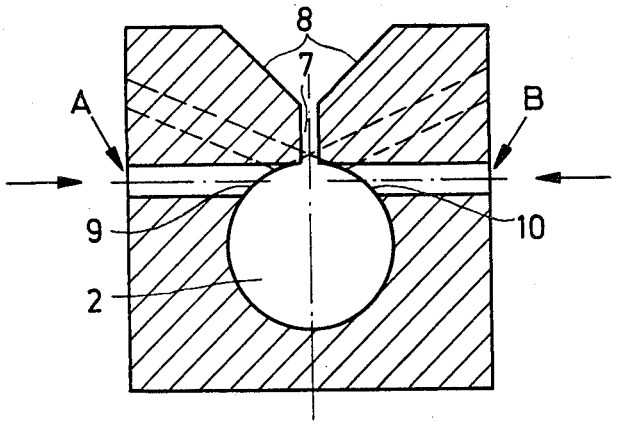
FIG. 3 is a transverse sectional view along III—III of FIG. 2.

The splicing head 1, as best seen in FIG. 3, is provided with an insertion slot 7 which lies in the median plane of turbulence chamber 2 through which slot the thread ends to be connected can be inserted into the chamber. To facilitate insertion of the thread ends, the outer opening of the insertion slot is provided with chamfered surfaces 8. Also as best seen in FIG. 3, the openings 9, 10 of pressure medium passages A, B extend tangentially into the peripheral wall of the turbulence chamber 2. In this way, it is possible to produce driving currents within chamber 2 which revolve alternately in clockwise and counterclockwise directions within chamber 2. As seen in FIG. 2, the angle between the axes of the pressure medium passages A, B is 180°, but different angles can exist between these channels as illustrated by the dashed lines in FIG. 3. It is particularly important that the openings 9, 10 open tangentially into the peripheral wall of chamber 2 independently of the position of the pressure medium passages.

Figure 4:
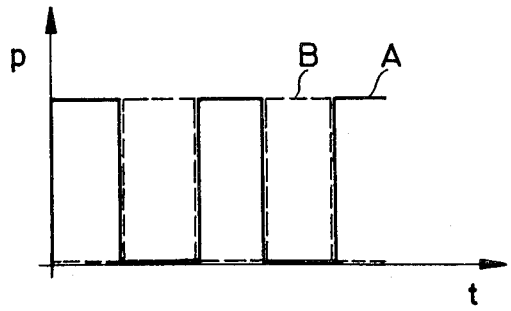
FIG. 4 is a pressure-time diagram showing the manner in which pressure is applied to the turbulence chamber.

As will be seen in the diagram of FIG. 4, the driving currents are produced alternately through the pressure medium passages A, B into chamber 2. Every effort should be made to be sure that only one of the driving currents is effective. This is illustrated in FIG. 4 wherein it is shown that the driving current comprising fluid pressure supplied to one of the two channels A, B is completely ended before the oppositely directed driving flow begins. The frequency of the driving currents is in the range of between about 1 and about 10 Hertz, this frequency to be adapted to the particular thread material being processed. The number of driving surges, or pulses, is also to be selected as a function of the material to be spliced, and in many cases one or two pulses in each direction is sufficient.

Figure 5:
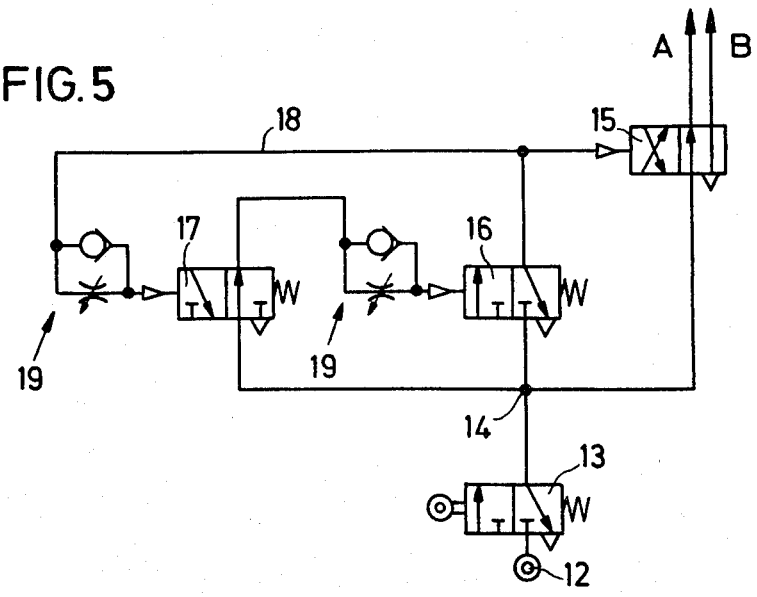
FIG. 5 is a schematic fluid flow diagram showing a pneumatic control system for controlling the flow of air under pressure to a splicing head.

FIG. 5 is a schematic circuit diagram of a fluid pressure system by which the driving currents or surges illustrated in FIG. 4 can be produced. From a source 12 of fluid under pressure, the pressure medium passes to a mechanically operable multiway valve 13 which is operated, for example, by a rotary cam, not illustrated, which stops or releases the pressure medium supply into the control system. The control system is also vented at the time of stoppage. The pressure medium passes from a line junction 14 to three pressure medium-operated reversing valves 15, 16 and 17 which are constructed as multiway valves. The valves are arranged so that the stop valve 15 alternately supplies one driving current pulse or surge to the channels A, B, while the reversing valve 16 alternately releases or vents the operation of reversing valve 15 and, consequently, the frequency of the alternating driving currents in the reversing valve 15 is determined. Reversing valve 17 vents or releases the pressure medium operation of the reversing valve 16 and is, in turn, controlled by the pressure medium flows or surges produced by valve 16 in line 18. A throttle check valve 19 is arranged in the pressure medium operating system of each of the reversing valves 16, 17, to permit one to adjust the frequency of the driving currents or surges supplied to channels A, B.

The frequency of the driving currents could also be controlled in some other way, for example, by an electrical control system for reversing valve 15. However, because in each case the pressure medium is required for subjecting turbulence chamber 2 to the alternately directed driving currents or surges, it is appropriate to control the complete splicing time (by valve 13) and the frequency of the driving currents by the pressure medium.

Figure 6:
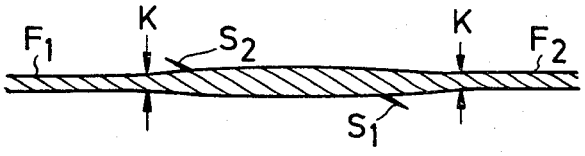
FIG. 6 is a diagrammatic view of a completed splice between two thread ends after joining in accordance with the method and apparatus of the invention.

FIG. 6 shows an example of a connection of two thread ends produced by the described method and the described splicing head 1. Locations K are clamping points at which the two thread ends $F_1$ and $F_2$ are held outside of the splicing head 1. Due to the alternating direction of the driving currents or surges, a uniform twisting of the thread ends is achieved. It is possible that after one cycle, i.e., after one driving surge in each direction, thread tips $S_1$, $S_2$ may still project somewhat, but they disappear if the driving currents act over two or more cycles.

During the practical performance of the splicing operation, it is advantageous if the pressure medium flow takes place in surge-like manner, or in pulses, as illustrated in FIG. 4. To reliably avoid undesirable interaction or influence of the driving currents on each other, the pressure medium passages A, B can be axially offset somewhat from each other in the direction of the longitudinal axis of the turbulence chamber 2.

The splicing head 1 is appropriately made from an abrasion-resistant material, e.g., steel, non-ferrous metal or plastic. The same means as in knotting devices on automatic spooling or winding machines can be used for inserting the thread ends in splicing head 1, such as that shown, for example, in German Auslegeschrift No. 12 56 571. The thread ends projecting from splicing head 1 are to be cut off and thereby brought to the correct size for splicing.

While certain advantageous embodiments have been chosen to illustrate the invention it will be understood by those skilled in the art that various changes and modifications can be made therein without departing from the scope of the invention as defined in the appended claims.

What is claimed is:

1. A method for splicing two thread ends comprising the steps of providing a splicing head having a turbulence chamber with a generally circular cross-section for receiving the thread ends to be spliced, inserting the thread ends into the chamber, tangentially injecting a fluid medium under pressure into the turbulence chamber through at least one first inlet opening to cause generally circular fluid flow in the chamber in one circumferential direction, terminating flow through the first inlet opening, tangentially injecting a fluid medium under pressure into the turbulence chamber through at least one second inlet opening to cause generally circular fluid flow in the chamber in the opposite circumferential direction, terminating flow through the second inlet opening, and repeating the steps of tangentially injecting and terminating flow alternately through the first and second openings.

2. A method according to claim 1 wherein in each of the steps of tangentially injecting fluid medium the medium is injected through at least two openings concurrently in the same circumferential direction.

3. A method according to claim 1 or 2 wherein fluid medium is injected alternately at a rate of between about 1 and about 10 Hz.

4. A splicing head for joining two thread ends together comprising a body having therein means defining a turbulence chamber with a generally circular cross-section, means defining an insertion slot extending inwardly from an outer surface of said body to said chamber for permitting insertion into said chamber of the thread ends to be joined, means defining at least one first fluid flow passage tangentially intersecting said chamber in a direction to cause circumferential flow in a clockwise direction within said chamber when supplied with fluid under pressure, and means defining at least one second fluid flow passage tangentially intersecting said chamber in a direction to cause circumferential flow in a counterclockwise direction when supplied with fluid under pressure; and means for alternately supplying fluid under pressure to said first and second passages.

5. A splicing head according to claim 4 wherein said first and second passages are directed toward each other.

6. A splicing head according to claim 4 wherein the openings of said first and second passages are axially offset from each other with respect to the chamber axis.

7. A splicing head according to claim 4 wherein the axes of said first and second passages are separated by an angle of equal or less than 180°.

8. A splicing head according to claim 4 wherein the openings of said first and second passages into said chamber are on opposite sides of said insertion slot.

9. A splicing head according to claim 4 wherein said insertion slot is separated from each of said passages by an angle of equal or less than 90°.

10. A splicing head according to claim 4 wherein said turbulence chamber comprises a central substantially cylindrical portion including the openings from said passages; and frustoconical end portions enlarging axially outwardly from said central portion.

* * * * *